United States Patent [19]

Passera, deceased et al.

[11] 3,951,121

[45] Apr. 20, 1976

[54] FUEL INJECTION SYSTEM

[75] Inventors: Walter Passera, deceased, late of Stuttgart, Germany, by Ludwig Passera, heir; Volkhard Stein, Stuttgart, Germany

[73] Assignee: Robert Bosch G.m.b.H., Stuttgart, Germany

[22] Filed: July 29, 1974

[21] Appl. No.: 492,828

[30] Foreign Application Priority Data

Aug. 3, 1973 Germany ..... 2339370

[52] U.S. Cl. ..... 123/139 AW; 123/139 A; 123/139 AH

[51] Int. Cl.² ..... F02M 39/00

[58] Field of Search .... 123/139 AW, 119 R, 139 R, 123/139 A, 139 AH

[56] References Cited

UNITED STATES PATENTS

| | | | |
|---|---|---|---|
| 2,800,121 | 7/1957 | Fletcher | 123/139 AW |
| 2,954,020 | 9/1960 | Ball | 123/139 AW |
| 3,680,535 | 8/1972 | Eckert | 123/139 AW |
| 3,713,430 | 1/1973 | Knapp | 123/139 AW |
| 3,728,993 | 4/1973 | Eckert | 123/139 AW |
| 3,739,758 | 6/1973 | Knapp | 123/139 AW |
| 3,765,387 | 10/1973 | Knapp | 123/139 AW |
| 3,791,359 | 2/1974 | Eckert | 123/139 AW |
| 3,796,200 | 3/1974 | Knapp | 123/139 AW |

*Primary Examiner*—Charles J. Myhre
*Assistant Examiner*—Daniel J. O'Connor
*Attorney, Agent, or Firm*—Edwin E. Greigg

[57] ABSTRACT

A fuel injection system for an internal combustion engine contains a fuel metering mechanism including first differential pressure diaphragm valves. The pressure difference prevailing at these valves can be changed by a second, electromagnetic, differential pressure diaphragm valve. The first and second differential pressure valves share a common diaphragm and the pretension of the closing spring in the second diaphragm valve can be adjusted from outside the housing of the fuel metering mechanism.

7 Claims, 4 Drawing Figures

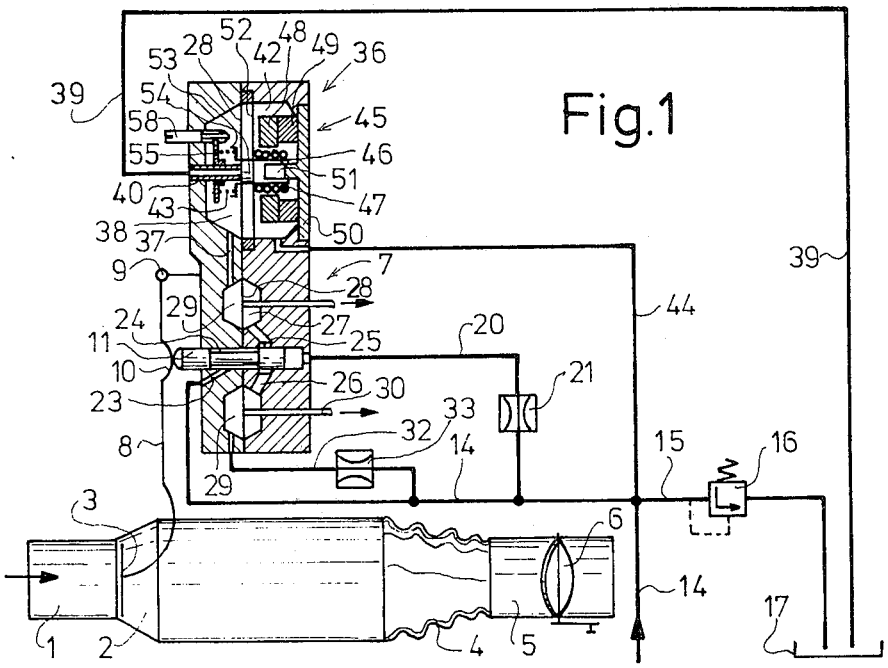
Fig.1
Fig.2
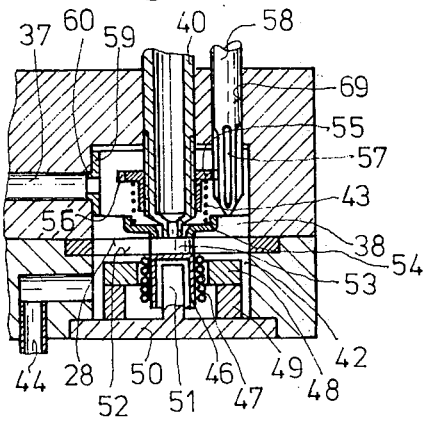
Fig.4
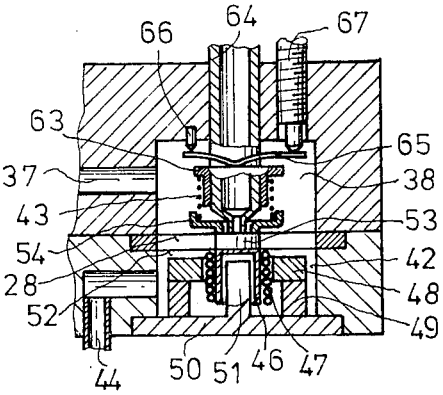
Fig.3
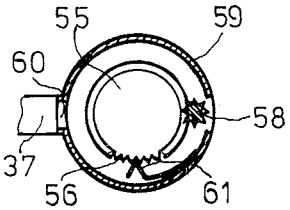

FUEL INJECTION SYSTEM

BACKGROUND OF THE INVENTION

The invention relates to a fuel injection system for a mixture-compressing, externally ignited internal combustion engine employing continuous injection into a suction tube.

Disposed within the suction tube are, sequentially, a measuring member and an arbitrarily actuatable butterfly throttle valve. The measuring member moves in response to the amount of air flowing through the suction tube and against a resetting force, thus setting the movable member of a valve disposed in the fuel line of the engine for the purpose of metering out a quantity of fuel proportional to the air quantity. The metering process takes place while a constant pressure difference exists across the valve. The magnitude of this pressure difference can, however, be changed, in dependence on engine parameters, by a hysteresis-free electromagnetic assembly. The assembly includes a permanent magnet and a moving coil armature, and acts upon a first differential pressure valve, embodied as a flat seat diaphragm valve. The diaphragm can be moved, by the force of a spring and also by the variable force due to the electromagnetic assembly, in the direction tending to open the first differential pressure valve.

In a known fuel injection system of this kind, the pressure difference prevailing at a metering and quantity divider valve is changeable by means of a second differential pressure valve. The internal operation of the differential pressure valves associated with the metering and quantity divider valve is based entirely on the diaphragm rigidity, i.e., without a spring counter force. This embodiment requires that the diaphragm be installed in the metering and quantity divider valve without stresses or deformations. In order to save constructional space and to make the fuel lines as short as possible, it is desired to locate the additional differential pressure valve within the metering and quantity divider valve. This brings the risk however, that during the assembly, the spring of the additional differential pressure valve will cause stresses and deformations in the diaphragm.

OBJECT AND SUMMARY OF THE INVENTION

It is an object of the invention to provide a fuel injection system which is so constructed that the diaphragm of the metering and quantity divider valve can be installed without latent stresses and deformations.

This object is achieved, according to the invention, in that the first differential pressure valve, as well as the second differential pressure valves, which maintain a constant pressure difference across the metering and quantity divider valve, share a common diaphragm acting as a movable valve member, and in that the pretension of a spring tending to open the first differential pressure valve is adjustable after assembly and installation of the valves.

In one preferred embodiment of the invention, the first differential pressure valve is equipped with a valve seat stem with external threads on which an internally threaded spring support cup, whose periphery is serrated, is rotatably mounted. The spring support cup can be rotated by means of a fluted pinion, disposed within the housing of the first differential pressure valve, parallel to the valve seat stem, the flutes of the pinion meshing with the serrations of the spring support cup.

In another preferred embodiment of the invention, the first differential pressure valve is equipped with a spring support cup which is slidably disposed on a valve seat stem whereon it may be displaced by a seesaw plate whose one end is supported on a pin, integral with the housing, and whose other end is supported by a screw.

The invention will be better understood, and further objects and advantages thereof will become more apparent from the ensuing detailed specification of these two exemplary embodiments, taken in conjunction with the drawing.

BRIEF DESCRIPTION OF THE DRAWING

FIG. 1 is a schematic diagram of a simplified fuel injection system according to the invention;

FIG. 2 is a sectional, schematic diagram of a first exemplary embodiment of the first differential pressure valve;

FIG. 3 is a plane view of an elastic ring with latch; and

FIG. 4 is a sectional, schematic diagram of a second exemplary embodiment of the first differential pressure valve.

DESCRIPTION OF THE PREFERRED EMBODIMENTS

In the fuel injection system shown in FIG. 1, combustion air flows in the direction of the arrow through a suction tube 1, which has a conical region 2, containing a measuring member 3. The air then flows through a connecting tube 4 and a suction tube region 5, containing an arbitrarily actuatable butterfly valve 6, to one or several cylinders (not shown), belonging to an internal combustion engine. The measuring member is embodied as a plate 3, disposed transversely to the direction of the air flow, which moves within the conical region 2 of the suction tube in accordance with an approximately linear function of the air quantity flowing through the suction tube. If the resetting force acting upon the measuring member 3, as well as the air pressure prevailing ahead of the measuring member 3 are both constant, then the pressure prevailing between the measuring member 3 and the butterfly valve 6 also remains constant.

The measuring member 3 directly controls a metering and quantity divider valve 7. A lever 8, which is mounted pivotably at a pivoting point 9, freely transmits the setting motions of measuring member 3. The lever 8 that has a projection 10 which actuates a movable valve member 11 of the metering and quantity divider valve 7, embodied as a control slide. A fuel pump, not shown, delivers fuel through a line 14 to the metering and quantity divider valve 7. Branching off from line 14 is a line 15, containing a pressure limiting valve 16 which permits the return of fuel to a fuel reservoir 17 whenever the system pressure becomes too high.

The control slide 11 is actuated by pressurized fluid which provides the resetting force for the measuring member 3 and acts on the control slide through a line 20, containing a throttle 21.

Fuel flows from line 14 through a channel 23 into an annular groove 24 of the control slide 11. Depending on the position of the control slide 11, the annular groove 24 overlaps to a greater or lesser extent the controls slits 25, each of which communicates through channels 26 with a chamber 27 which is separated by a diaphragm 28 from a chamber 29. From chambers 27, fuel flows through channels 30 to the individual fuel injection valves (not shown) which are disposed within the suction tube in the vicinity of the cylinders of the engine. The diaphragm 28 serves as the movable member of each of the second differential pressure valves embodied as flat seat valves. A line 32, including a throttle 33, branches off from fuel line 14 and it leads to the several chambers 29 of the individual second differential pressure valves. The fuel pressure in the chambers 29 may be changed by a first differential pressure valve 36, acting through line 37. If the first differential pressure valve 36 is in the open position, fuel may flow back from a chamber 38 through a channel 39 into the fuel reservoir 17.

The first differential pressure valve 36 is embodied as a flat seat valve with a fixed valve seat stem 40 and the diaphragm 28 separating the two chambers 38 and 42. A spring 43 loads the first differential pressure valve 36 in the direction of opening. Since chamber 42 is separated from chamber 38 by the diaphragm 28, the pressure in chamber 42 is that of the fuel admitted through a line 44 prior to metering. Disposed within the chamber 42 is an electromagnetic assembly 45, containing a moving coil armature 46, a coil 47, a soft iron core 48, a permanent magnet 49 and a soft iron plate 50. The soft iron plate 50 has a core 51 which extends into the moving coil armature 46 suspended from a leaf spring 52. The connection between the leaf spring 52 and the diaphragm 28 is provided by an intermediate member 53. The spring 43 is disposed between a spring support cup 54 and another spring support cup 55. The spring support cup 55 is internally threaded and is rotatable on the valve seat stem 40, equipped with matching, external threads. The periphery of the spring support cup 55 is provided with serrations 56 (see FIG. 2) which are engaged by a pinion 58 provided with complementary serrations or flutes 57. The rotation of the spring support cup 55 during continuous operation of the engine is prevented by a spring 59 with a projection 60 and a latch 61. Spring 59 is inserted in the chamber 38 under tension and its projection 60 extends into the line 37. In the exemplary embodiment of the first differential pressure valve shown in FIG. 4, the spring 43 is disposed between the spring support cup 54 and a spring support cup 63, the spring support cup being slidably mounted on a valve seat stem 64. The spring support cup 63 may be adjusted by means of a seesaw plate 65, whose one end is supported on a pin 66, fixed to the housing, and whose other end is supported by a screw 67.

The method of operation of the fuel injection system illustrated is as follows:

When the internal combustion engine is running, air is aspirated through the suction tube 1, 2, 4, 5 and causes a certain amount of displacement of the measuring member 3 from its normal, rest position. Corresponding to the excursion of the measuring member 3, the lever 8 displaces the control slide 11 of the metering and quantity divider valve 7, which meters out the fuel quantity flowing to the injection valves. The direct connection between the measuring member 3 and the control slide 11 results in maintaining a constant proportion between the air quantity and the metered-out fuel quantity.

In order to maintain the fuel-air mixture in a relatively richer or leaner condition, depending on the domain of operation of the internal combustion engine, a change of the normally constant pressure difference prevailing at the metering and quantity divider valve 7 is required in dependence on engine parameters, for example, the oxygen content of the exhaust gases. It is suitable to provide for this purpose, within the exhaust gas line of the internal combustion engine, a so-called oxygen sensor, which, by means of an electronic circuit, changes the current flowing through coil 47 of the electromagnetic assembly 45. This results in greater or lesser magnetic attraction of the moving coil armature 46 toward the core 51, i.e., in the direction of relieving spring 43. Thus, the metered fuel quantity can be altered by a change of the differential pressure prevailing at the metering and quantity divider valve 7. The feedback loop is free of hysteresis because, as embodied, the electromagnetic assembly 45 includes a moving coil armature 46 and a permanent magnet 49.

The resetting force for closing the second differential pressure valves, formed by chambers 27, 29 and the diaphragm 28, is provided solely by the inherent rigidity of the diaphragm 28. Even small irregularities of the diaphragm, for example, stresses or deformations, are especially detrimental with respect to the uniform distribution and/or the metering precision provided by the metering and quantity divider valve, especially when small amounts of fuel are involved. Thus it is necessary that the first differential pressure valve 36, integrated within the metering and quantity divider valve 7, be installed without pre-stressing spring 43. For this reason, when the first differential pressure valve 36 is assembled, the spring 43 is installed between the two spring support cups 54 and 55 or 63 without any pretension. In the first exemplary embodiment according to FIG. 2, the valve seat stem 40 has external threads on which the correspondingly internally threaded spring support cup 55 is rotatably mounted. The periphery of the spring support cup 55 is equipped with serrations 56. Once operational engine conditions prevail, the basic setting of the spring 43 can be effected by turning the pinion 58 which is mounted parallel to the valve seat stem 40 in a bore 69 and is provided with flutes or serrations 57, which engage the complementary serrations 56 of the spring support cup 55 which is displaced toward diaphragm 28. When the electromagnetic assembly 45 is not energized, i.e., when it is currentless, the force of the spring 43 determines the differential pressure prevailing in the first differential pressure valve 36 and in the second differential pressure valves. Serrations 56 are also engaged by a latch 61 which secures spring support cup 55 against unintentional rotation during engine operation. The pinion 58 is guided within bore 69 and can be removed after the pretension of spring 43 has been set. The bore 69 can be closed with a stopper. However, the pinion 58 can be so embodied that it always remains connected with the housing of the metering and quantity divider valve.

In the second exemplary embodiment, illustrated in FIG. 4, the spring support cup 63 is axially slidable, with small clearance, on the valve seat stem 64. Its position is adjustable by a screw 67 and a seesaw plate 65. One end of the seesaw plate rests on a pin 66. During the pretensioning of spring 43, the force exerted on the spring support cup 63 is applied almost centrally so as to avoid tilting the spring support cup on the valve seat stem 64. The end of the seesaw plate nearest screw 67 is horizontal in the pretensioned condition of the spring 43.

When the first differential pressure valve 36 is constructed according to the invention, the basic setting of the spring 43 can, therefore, be made from the outside of the housing and after assembly of the metering and quantity divider valve. A new setting or a resetting can also be obtained simply and during engine operation without requiring disassembly of the metering and quantity distribution valve.

The above description is of preferred embodiments of the invention and modifications may be made thereto without departing from the spirit and scope of the invention.

What is claimed is:

1. In a fuel injection system for a mixture-compressing, externally ignited, internal combustion engine, which includes a fuel line; a suction tube through which air for combustion is aspirated and into which continuous fuel injection occurs; an air-flow measuring member located within the suction tube; an arbitrarily actuatable butterfly valve located within the suction tube downstream of said air-flow measuring member; a first, electromagnetically controlled, differential pressure diaphragm valve including a diaphragm and a spring; a fuel metering and quantity divider valve located in the fuel line and serving to meter out a fuel quantity proportional to the air quantity, said fuel metering and divider valve including a fuel-flow control slide which is displaced against a resetting force by a part of the air-flow measuring member as a function of the air quantity flowing through the suction tube and second differential pressure diaphragm valves for maintaining a normally constant pressure difference prevailing at said metering and divider valve and for regulating the amount of fuel delivered by the fuel metering valve; and a hysteresis-free electromagnetic assembly including a permanent magnet and a moving coil armature, said electromagnetic assembly being arranged to act upon said first differential pressure valve and in response to at least one engine parameter to change the normally constant pressure difference prevailing at said fuel metering and divider valve, wherein the diaphragm of said first differential pressure diaphragm valve is displaced in an opening direction by the interaction of the forces exerted by said spring and said electromagnetic assembly, the improvement comprising:

a. a single diaphragm, common to both said first and said second differential pressure diaphragm valves and located within the housing of said fuel metering and quantity divider valve within which the spring of said first differential pressure diaphragm valve is located; and b. means mounted to the housing of said fuel metering and quantity divider valve for permitting external adjustment of the tension in said spring of said first differential pressure diaphragm valve.

2. A fuel injection system as defined in claim 1, wherein said means permitting the external adjustment includes in said first, electromagnetically controlled, differential pressure diaphragm valve an externally threaded valve seat stem mounted to the housing of said fuel metering and quantity divider valve and an internally threaded spring support cup rotatably mounted on said valve seat stem to support said spring.

3. A fuel injection system as defined in claim 2, wherein the periphery of said spring support cup is serrated.

4. A fuel injection system as defined in claim 3, wherein said means permitting the external adjustment further includes a fluted pinion mounted to the housing of said fuel metering and quantity divider valve, said pinion being mounted to extend within the housing of said first differential pressure valve, parallel to said valve seat stem, whose flutes mesh with said serrations of said spring support cup to permit the rotation thereof by said fluted pinion.

5. A fuel injection system as defined in claim 3, wherein said means permitting the external adjustment further includes an elastic ring with a latch mounted within the housing of said fuel metering and quantity divider valve, wherein the latch engages said serrations of said spring support cup to tend to prevent the rotation thereof.

6. A fuel injection system as defined in claim 1, wherein said means permitting the external adjustment includes in said first, electromagnetically controlled, differential pressure diaphragm valve a spring support cup slidably mounted on said valve seat stem to support said spring.

7. A fuel injection system as defined in claim 6, wherein said means permitting the external adjustment further includes a seesaw plate, a support pin and an adjustment screw, all located within said first differential pressure diaphragm valve, one end of the seesaw plate resting on said support pin, the other end resting on the tip of said adjustment screw and the fulcrum of said seesaw plate bearing against and displacing said spring support cup when said adjustment screw is turned, and wherein both the support pin and the adjustment screw are mounted to the housing of said fuel metering and quantity divider valve.

* * * * *